United States Patent [19]

Nijhuis

[11] 4,007,580

[45] Feb. 15, 1977

[54] METHOD FOR THE MANUFACTURE OF TWISTLESS OR SUBSTANTIALLY TWISTLESS YARN AND YARN WHENEVER MANUFACTURED BY THE APPLICATION OF THIS METHOD

[75] Inventor: Jan Nijhuis, Hengelo (O), Netherlands

[73] Assignee: Hollandse Signaalapparaten B.V., Hengelo, Netherlands

[22] Filed: Apr. 23, 1975

[21] Appl. No.: 570,729

[30] Foreign Application Priority Data

May 6, 1974 Netherlands ..... 7406030

[52] U.S. Cl. ..... 57/140 BY; 57/164

[51] Int. Cl.[2] ..... D02G 3/04; D02G 3/40

[58] Field of Search ..... 57/140 BY, 140 R, 157 R, 57/157 MS, 157 TS, 164

[56] References Cited

UNITED STATES PATENTS

| | | | |
|---|---|---|---|
| 3,447,310 | 6/1969 | Bok et al. | 57/164 |
| 3,745,757 | 7/1973 | Selwood | 57/157 R |
| 3,828,542 | 8/1974 | Boutonnet et al. | 57/157 TS X |
| 3,874,160 | 4/1975 | Kitazawa et al. | 57/157 TS |
| 3,877,214 | 4/1975 | Van der Werf | 57/164 |
| 3,945,186 | 3/1976 | Van Dort | 57/140 BY X |

*Primary Examiner*—Richard C. Queisser
*Assistant Examiner*—Charles Gorensttein
*Attorney, Agent, or Firm*—Frank R. Trifari; David R. Treacy

[57] ABSTRACT

In a method of manufacturing twistless yarn a sliver or roving comprising at least two staple fibre components of which at least one is a potential adhesive, is subsequently wet-drafted, false twisted, moistened again, whereafter the potential adhesive is activated and the staple fibre material is dried.

7 Claims, No Drawings

METHOD FOR THE MANUFACTURE OF TWISTLESS OR SUBSTANTIALLY TWISTLESS YARN AND YARN WHENEVER MANUFACTURED BY THE APPLICATION OF THIS METHOD

The invention relates to a method for the manufacture of twistless or substantially twistless yarn and to the yarn whenever manufactured by the application of this method. In applying this method a sliver or roving is used, which comprises at least two staple fibre components of which at least one is a potential adhesive providing for the bonding of the staple fibres. The sliver or the roving is wet-drafted and false twisted; in the fibre strand thus obtained the adhesive component is subsequently activated and, finally, the fibre strand is dried. Such a method is described in the Dutch Pat. No. 144,679 granted May 16, 1975, and the corresponding co-pending U.S. application Ser. No. 404,342, filed Oct. 9, 1973 and assigned to the assignee of the instant application, which shows that the sliver or the roving, before the drafting process, is wetted with warm water for drafting purposes, while the adhesive fibre component is activated, as more fully described hereinafter. If the adhesive component consists of a non-stabilized polyvinyl alcohol fibre and the sliver or roving is wetted with water at a temperature approximately equal to the gelatinising temperature of the polyvinyl alcohol fibre, it is found that a part of the polyvinyl alcohol fibre does not fully dissolve, an approximately equal part is fully dissolved and the major part turns into a gelatinous state. The result is that during drafting and false twisting an amount of water and hence a part of the fully dissolved polyvinyl alcohol fibres are removed from the assembly of staple fibres being fed through, while the machine will be fouled when it is in use for a long period. If these disadvantages are to be avoided, the staple fibres to be drafted must be wetted with cold water and the component providing for the bonding must be activated at a later stage in the manufacturing process. This is, however, known from the U.S. Pat. No. 3,447,310, which describes that the bonding agent is applied during drafting; this agent is not or practically not activated in the cold water. The activation does not occur before the drafted fibres undergo a steam treatment after winding into a package. The Dutch Pat. application No. 7314584, also describes a method for the bonding of drafted but unheated staple fibres. Also in this case the drafting process occurs in a wet condition realised by cold water only. Because the liquid contents of the drafted staple fibres, i.e. the fibre strand, was too small for an adequate activation process, a steam cylinder was used, where steam is supplied in a direction opposite to the direction of motion of the fibre strand through the cylinder. This method has the disadvantage that the liquid contents and the temperature of the fibre strand being fed through cannot properly be controlled at high speeds, affecting the process reliability adversely. The application of steam affects both the amount of liquid and the temperature simultaneously. In practice, individual control of these two parameters is difficult to realise.

It is an object of the present invention to solve the problems indicated above. According to the present invention therefore, liquid is reintroduced between the staple fibres in the period between false twisting and activation, the amount of liquid being as much as required to increase the liquid contents of the fibre strand to a predetermined value, which value depends on the choice of the potentially adhesive components and on the desired degree of activation and can be determined by simple testing such as that shown by the example given below. In this way it is attained that the liquid regulation and the heating to the desired activation temperature are applied separately.

The reintroduction of liquid in the period between false twisting and activation may be realised in several ways, viz. by squirting the fibre strand with a liquid jet or by passing the fibre strand through a liquid or a liquid vapour.

The activation following the wetting and the drying processes can be executed in any conventional way, for example such as described in the aforementioned Dutch patent No. 144,679 and copending U.S. application.

This patent and co-pending application teach bringing the wet, drafted ribbon into contact with a heated surface, the contact duration and the temperature of this surface being determined by the composition and the feed-through rate of the fibre ribbon to be bonded. The entire bonding process occurs prior to winding the ribbon to a package.

More particularly, a roving is drawn from a roving wheel, transferred via guide rollers and brought into a wet condition by a hot water supply, and then drafted by drafting rollers to a thinner fibre ribbon. The process of activation is started or accelerated early in the process, even before passing through a false-twisting device.

Activation is then completed after false twisting by passing the ribbon over a heater, which comprises a heated drum and a guide roller having parallel axes, the ribbon passing over a portion of the drum and then over a portion of the guide roller, back to the drum to complete a first turn, and continuing to pass successively over a portion of the drum and a portion of the guide roller for a number of turns before passing to a package winding device. To avoid contact between adjacent turns of the ribbon, the guide roller contains circumferential grooves at least equal in number to the total number of turns around the drum and guide roller. To avoid high tension in the ribbon passing around the drum, the drum rotates about its axis with a peripheral speed corresponding approximately to that of the rubber roller of the last or feed-out pass of the drafting rollers. Correct tension in the ribbon between the drafting rollers and the initial point of contact with the guide roller, including point of contact with the guide roller, including passage through the false twisting unit, is extremely important. To maintain this tension the motion transfer is such that the peripheral speed of the drum is 2% to 3% greater than that of the serrated roller of the last pass of the drafting rollers.

In the preferred embodiment described in that Dutch patent and U.S. application, the heating drum is fabricated from a good heat-conducting metal, clad with a polytetrafluorethylene plastic, and heated by a heating element such as a burner whose flame is directed to the interior of the drum. Through use of the PTFE surface layer adhesion of the wet fibre ribbon to the heated drum surface is prevented. The heating of the fibre ribbon, and in consequence the bonding of the yarn, occur during the time the ribbon is resting on the heated surface of the drum. Depending on the time of contact duration required to bond a specific ribbon at a specific drum temperature, and a given feed-through rate of the fibre ribbon, the distance of drum surface contact may be calculated. In order to provide that necessary circumferential contact, rather than using a very large diameter single-turn drum, the number of turns for a smaller drum is readily calculated. By way of example, the Dutch patent and U.S. application teach the bonding of a roving consisting of stabilized polyvinyl alcohol fibres containing about 4% unstabilized polyvinyl alcohol fibres as a bonding agent, in a wet condition from 65° to 70° C water, at a feed-through rate of 2 m/sec, the drum surface temperature being 160° to 180° C, and the contact duration about 1.5 seconds. This required six turns about the drum and grooved roller, following which the yarn was passed over a tensioning roller and wound on the packaging device. This yarn was found to be so strong that it could be used directly as warp yarn in a weaving process, without further reinforcement treatment.

By the reintroduction of liquid it is possible to apply for the wet drafting a liquid different from that for the activation. Instead of using water for both the wet drafting and the activation, the wet drafting may be done with water and the activation with a suitable organic solvent. If for example di- or triacetate fibres are used as the bonding components, the wet drafting can be done after wetting with water and the rewetting for the activation with acetone, formic acid or acetic acid.

However, the amount of liquid to be reintroduced between the fibres after false twisting is such that the liquid contents of the fibre strands can be controlled within rather narrow limits. If, as stated before, an unstabilized polyvinyl alcohol fibre is used as the bonding component, the degree of bonding during the drying process depends on the degree in which the polyvinyl alcohol fibres are activated. This activation may vary from a somewhat sticky state, through partial or complete gelatinising, to the fully dissolved state. The properties of the bonded fibre strand (twistless yarn) directly depend on the way in which the bonding of the fibres in question is realised, while the bonding directly depends on the degree of activation of the polyvinyl alcohol fibre. It has been found that the amount of liquid influences the degree of activation very strongly. It will therefore be clear that accurate control of the amount of liquid in the fibre strand after the false twisting process in accordance with the instant invention is most essential, since this affects the usability of the yarn.

EXAMPLE

A yarn of Tex 60 (Ne 10) was obtained from a blending of staple fibres consisting of 94.5% modified viscose rayon fibres and 5.5% unstabilized polyvinyl alcohol fibres. The unstabilized polyvinyl alcohol fibre had a gelatinising temperature of 60° C. The fibre blend was drafted, using water of a temperature of 30° C. After false twisting following the drafting process the amount of water in the fibre blend was 87% of the weight of the yarn. Without adding more water this produced, after activation and drying, for example as taught by the aforementioned Dutch patent and co-pending U.S. application, a twistless yarn with a single-thread yarn strength of 665 grams at break. The same test was twice repeated under the same circumstances with the exception that after the false twisting more water was added. In a first case the water content in the fibre blend appeared to be 107% by weight of the yarn. In a second case an unknown greater quantity of water was added, whereby afterwards the water content of the fibre blend appeared to be 122%. In these cases a yarn was obtained with a single-thread yarn strength of 867 and 1110 grams at break, respectively.

What we claim is:

1. Method of manufacturing twistless yarn or substantially twistless yarn from a sliver or roving comprising at least two staple fibre components of which at least one is potentially adhesive upon the application of at least a liquid, including the sequential steps of:

a. applying liquid to the sliver or roving;
b. wet-drafting the sliver or roving to a thinner fibre strand;
c. false twisting said thinner fibre strand;
d. reapplying liquid to the false twisted fibre strand to increase the liquid content in the fibre strand;
e. activating the potentially adhesive component in the fibre strand; and
f. drying the fibre strand.

2. Method as claimed in claim 1, wherein the liquid is applied to the fibre strand by squirting said strand with a liquid jet.

3. Method as claimed in claim 1, wherein the liquid is applied to the fibre strand by passing said strand through a liquid.

4. Method as claimed in claim 1, wherein the liquid is applied to the fibre strand by passing said strand through a liquid vapour.

5. Twistless or substantially twisted yarn whenever manufactured by the application of a method as claimed in claim 1.

6. A method as claimed in claim 1 wherein said reapplying step comprises replenishing liquid content lost during the drafting and false twisting steps to increase said liquid content to a predetermined value.

7. A method as claimed in claim 1 wherein said reapplying step comprises applying a liquid different from that applied in step a.

* * * * *